US005529215A

United States Patent [19]

Banks et al.

[11] Patent Number: 5,529,215

[45] Date of Patent: Jun. 25, 1996

[54] PERSONAL DEFENSE BATON

[76] Inventors: Rondal T. Banks, 4618 Ben Jared Rd., Baxter, Tenn. 38544; James W. Taylor, P.O. Box 667, McMinnville, Tenn. 37110

[21] Appl. No.: 377,637

[22] Filed: Jan. 26, 1995

[51] Int. Cl.[6] ..... B67D 5/33

[52] U.S. Cl. ..... 222/113; 222/153.13; 222/162; 222/402.11; 222/402.15; 42/1.08; 362/96

[58] Field of Search ..... 222/3, 78, 79, 222/113, 192, 153.13, 153.14, 162, 192, 325, 402.11, 402.15, 321.1; 42/1.08; 362/96, 102, 234, 253

[56] References Cited

U.S. PATENT DOCUMENTS

| | | | |
|---|---|---|---|
| 1,598,784 | 9/1926 | Rae et al. | 42/1.08 |
| 1,897,992 | 2/1933 | Ailes | 42/1.08 |
| 2,855,497 | 10/1958 | Bacon | 362/96 |
| 3,635,374 | 1/1972 | Anketell | 273/84 R |
| 3,776,429 | 12/1973 | DeLucia | 222/162 |
| 4,223,804 | 9/1980 | Morris et al. | 222/3 |
| 4,402,430 | 9/1983 | Fox et al. | 42/1.08 |
| 4,449,474 | 5/1984 | Mariol | 116/2 |
| 4,819,137 | 4/1989 | Hamilton | 362/102 |
| 4,964,636 | 10/1990 | Ashihara | 273/84 |
| 5,086,377 | 2/1992 | Roberts | 362/102 |
| 5,108,098 | 4/1992 | Ashihara | 273/84 |
| 5,197,734 | 3/1993 | Ashihara | 273/84 |
| 5,420,766 | 5/1995 | Hollis | 222/113 |
| 5,446,985 | 9/1995 | Chen | 362/96 |

*Primary Examiner*—Andres Kashnikow
*Assistant Examiner*—Philippe Derskshani
*Attorney, Agent, or Firm*—David J. Hill

[57] ABSTRACT

A personal defense baton is disclosed which which may be utilized to direct a spray of a personal defense gas toward an assailant. The personal defense baton of this invention comprises an elongate tube member which includes at one end a compartment for receiving a defense spray container. The defense spray container has a valve for dispersal therethrough of a personal defense gas and a discharge nozzle which communicates with the valve so as to direct a spray of the personal defense gas from the container in a generally axial direction from the end of tube member in which the container is located when the valve is actuated. The baton also includes apparatus for manually actuating the valve without bringing the actuating hand near the discharge nozzle.

8 Claims, 3 Drawing Sheets

PERSONAL DEFENSE BATON

FIELD OF THE INVENTION

This invention relates generally to non-lethal, personal defense devices which are adapted to be carried by persons for self protection, and more particularly, to such a device which may be utilized to direct a spray of a personal defense gas toward an assailant.

DESCRIPTION OF THE PRIOR ART

It is well known that the frequency of crimes against persons has increased in recent years. Furthermore, crimes of this sort are now being committed with increasing frequency in areas previously thought safe, such as in residential neighborhoods and near shopping centers. Consequently, many people now carry a personal alarm which may be activated to generate a loud noise, or a personal defense spray device that may be utilized to emit an offensive or immobilizing spray, such as of tear gas or pepper gas, against an assailant. It is also known to combine a personal defense spray device with a flashlight and/or with a police-type baton.

Thus, for example, U.S. Pat. No. 4,223,804 of Morris et al. describes a personal defense device which combines a flashlight with a renewable, interchangeable canister containing compressed gas which may be used to generate a noise or to disperse a dye and/or an odoriferous spray. The compressed gas canister of this device includes a dispensing nozzle of the type that is designed to dispense the gas when the nozzle is moved axially relative to the long axis of the canister. The nozzle is disposed in a sliding throat assembly, which may be displaced to release the contents of the canister by a pivoted trigger engaging a pivoted arm assembly. However, one of the problems with the device of Morris et al., as well as with many other devices of this sort, is the fact that in order to actuate the trigger to dispense the contents of the canister, the actuating hand must be brought near the nozzle through which the contents are dispersed. This increases the risk that the user of the device will accidentally come in contact with a noxious or incapacitating spray. In addition, the trigger mechanism of Morris et al. doubles as a protective cap for the nozzle. After the nozzle of Morris et al. is used to dispense a portion of the contents of the canister, residual material remaining in or on the nozzle can easily be transferred to the trigger mechanism when it is closed over the nozzle. A subsequent use of the trigger could transfer the residual material from the trigger to the finger of the user.

Another disadvantage of the personal defense device of Morris et al. is that it may be subject to accidental discharge. It is not the sort of device that will typically be carried by a user in his hand, but rather in a coat pocket or purse. The trigger mechanism could be exposed and activated by contact with objects in a pocket or purse, or upon withdrawal therefrom.

A personal defense device that combines a whistle, an aerosol spray canister and a flashcube which is actuated by the same trigger that actuates the canister is described in U.S. Pat. No. 4,449,474 of Mariol. An inner housing containing the aerosol spray canister and the flashcube is designed to telescope inwardly and outwardly from an outer housing, at one end of which a whistle is formed. To operate the spray canister and flashcube, the inner housing is telescoped outwardly from the outer housing. This action exposes the spray aperture and an opening in the inner housing in which a finger may be inserted to activate the canister trigger. The trigger of Mariol is actually a dispensing nozzle of the type that is designed to dispense the gas when the nozzle is moved axially relative to the long axis of the canister. By depressing the nozzle or trigger, the canister is moved axially within the inner housing, which movement activates the flashcube. In addition, as the nozzle is depressed further, the contents of the canister are released through the spray aperture. As in the personal defense device of Morris et al., the actuating hand must be brought near the nozzle through which the contents are dispersed, in order to dispense the contents of the canister. This increases the risk that the user of the device will accidentally come in contact with a noxious or incapacitating spray.

A personal defense device which combines a flashlight with a replaceable aerosol defense spray is described in U.S. Pat. No. 5,086,377 of Roberts. This device is comprised of a baton having a central grip that is configured to accommodate the fingers of the user when the device is grasped. The device also contains two housing members, one at each end of the central grip. One of the housing members may contain a flashlight, and the other contains an aerosol defense spray container which is actuated by a slide switch opposite the grip. The grip and slide switch are arranged so that when the device is properly grasped, the user's thumb will be positioned over the slide switch, whereby the switch may be actuated to disperse the spray through a nozzle located at the end of the grip adjacent to the housing member which contains the spray container. However, this nozzle, which directs the spray in a radial direction from the baton, is located immediately adjacent to the fingers of the user on the grip, so that actuation of the slide switch will cause the spray to be dispensed from a point very near to the fingers of the user. A user would have to be careful to avoid getting the spray on his fingers when actuating the device. This might not be easy during a moment of stress or panic, such as when circumstances might require that the device be used.

U.S. Pat. No. 4,964,636, U.S. Pat. No. 5,108,098 and U.S. Pat. No. 5,197,734, all of Ashihara, describe side-handle or cross-handle batons such as are commonly carried by law-enforcement personnel. Such batons are designed primarily as weapons for striking against an assailant, and are comprised of a club portion and a cross-handle which is attached to the club portion in a radial direction to the long axis of the club. Generally, such batons are gripped by the cross-handle, about which the club portion may be rotated. However, the cross-handle batons of Ashihara also incorporate various accessories, such as lights and gas-ejecting devices. In the embodiments of U.S. Pat. No. 4,964,636 which incorporate a gas-ejecting device, the free hand, which does not engage the grip of the cross-handle, is used to actuate a switch on the club portion to set off the gas bomb. In several embodiments of U.S. Pat. No. 5,108,098 and of U.S. Pat. No. 5,197,734 which incorporate a gas-ejecting device, the device is mounted on or in the cross-handle and requires the actuating hand to come in close proximity to the spray nozzle to actuate the ejection of gas. One embodiment of U.S. Pat. No. 5,197,734 includes a gas-ejecting device mounted in the club portion, which is actuated by a trigger in the cross-handle.

As can be seen from the foregoing discussion, several types of personal defense devices are available today. Most of these devices that incorporate a personal defense spray require that the hand of the user that actuates the personal defense spray come very near to the nozzle from which the spray is dispensed. Given the fact that the use of a personal defense device will necessarily occur during a moment of stress or panic, it is quite likely that a user will not take the care required to avoid coming into contact with the spray.

Furthermore, although cross-handle batons of the type normally carried by police personnel may incorporate accessory devices such as gas-ejecting devices, such batons are bulky and heavy, and their proper and safe use requires considerable training. Even though they may incorporate accessory devices, their principal use is as a sort of leveraged billy club. Cross-handle batons are specialized tools for law-enforcement personnel, and they are not the sort of devices that are suitable for general use for self-protection.

OBJECTS AND ADVANTAGES OF THE INVENTION

Accordingly, it is an object of the invention claimed herein to provide a non-lethal personal defense baton that is suitable for general use for self-protection. It is another object of the invention to provide such a baton that may be utilized to direct a spray of a personal defense gas towards an assailant, while avoiding the disadvantages and limitations of previously-known devices which require the user to bring his hand very near the nozzle through which the spray is dispersed in order to actuate the spray.

It is yet another object of this invention to provide a personal defense baton that may be grasped by a user in one hand and utilized to direct a spray of a personal defense gas in an axial direction from the baton towards an assailant. It is still another object of this invention to provide such a device that includes a light that may be directed in an axial direction from the baton along the path of the spray. Another object of this invention is to provide such a personal defense baton that includes a safety mechanism that may be manually actuated to disable the defense gas spray without bringing the actuating hand near the spray discharge nozzle.

It is yet another object of this invention to provide a personal defense baton which incorporates a replaceable canister of a personal defense gas.

Additional objects and advantages of this invention will become apparent from an examination of the drawings and the ensuing description.

SUMMARY OF THE INVENTION

A personal defense baton is disclosed which which may be utilized to direct a spray of a personal defense gas toward an assailant. The personal defense baton of this invention comprises an elongate tube member which includes at one end a compartment for receiving a defense spray container. The defense spray container has a valve for dispersal therethrough of a personal defense gas and a discharge nozzle which communicates with the valve so as to direct a spray of the personal defense gas from the container in a generally axial direction from the end of tube member in which the container is located when the valve is actuated. The baton also includes means for manually actuating the valve without bringing the actuating hand near the discharge nozzle.

In order to facilitate an understanding of the invention, several embodiments of the invention are illustrated in the drawings, and a detailed description of the preferred embodiments follows. It is not intended, however, that the invention be limited to the particular embodiments described or to use in connection with the apparatus shown. Various changes are contemplated such as would ordinarily occur to one skilled in the art to which the invention relates.

DESCRIPTION OF THE PREFERRED EMBODIMENTS OF THE INVENTION

Figure 1:
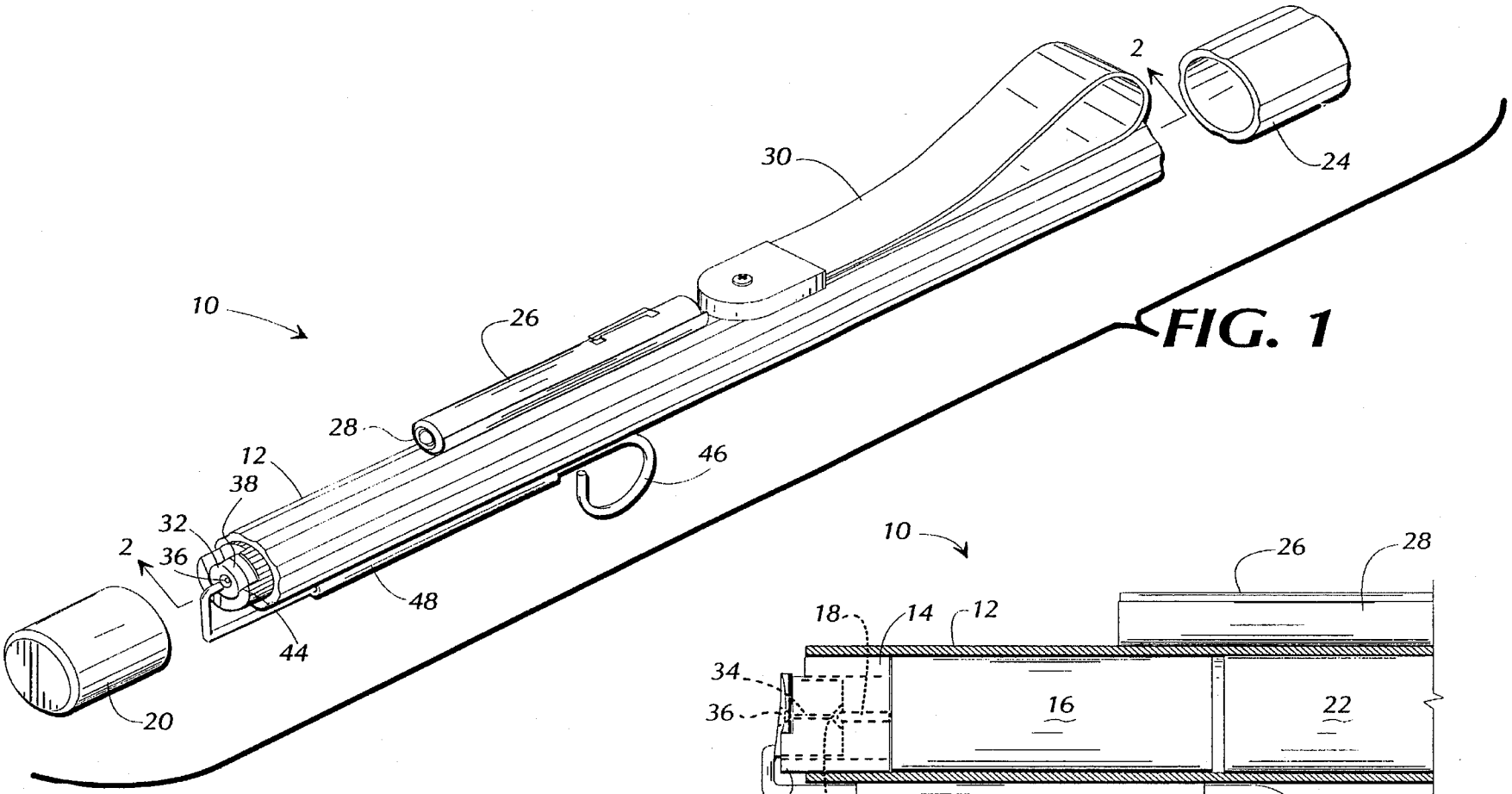
FIG. 1 is a perspective view of a preferred embodiment of the invention.
Figure 2:
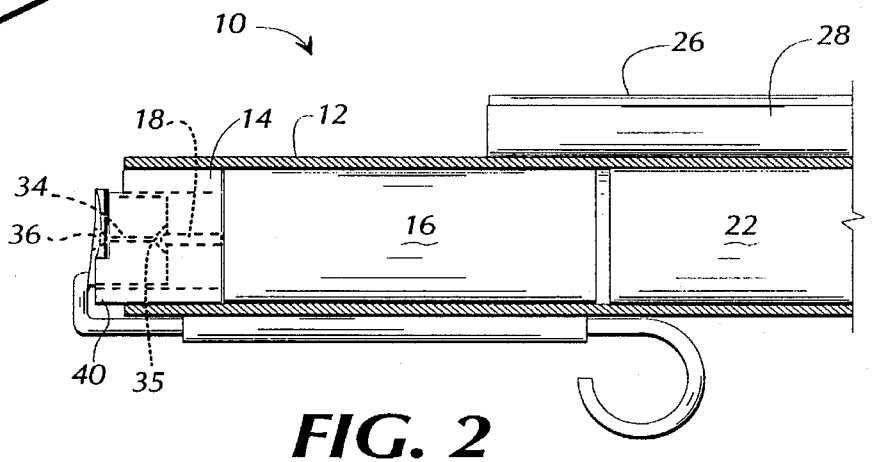
FIG. 2 is a sectional view taken along lines 2—2 of FIG. 1.

FIGS. 1–4 illustrate a preferred embodiment of the invention. This embodiment, generally designated by the reference numeral 10, includes an elongate tube member or barrel 12. Barrel 12 may be constructed of various materials, and preferably of a durable, moldable, impact-resistant plastic material such as ABS (acrylonitrile butadiene styrene) or "LEXAN" polycarbonate resin material. At one end of barrel 12 is located compartment 14, which is suitable for receiving a replaceable personal defense gas container or canister 16. Container 16 includes valve 18, through which the contents may be discharged. Such containers are commonly available for dispersing an immobilizing spray such as of tear gas, pepper gas or a combination thereof. Some of the sprays now available also contain an invisible ultraviolet-light-sensitive dye for suspect identification by the police. Preferred results have been obtained from a use in this invention of "SABRE" tear gas compound, a mixture of military CS tear gas and pepper gas which also contains an ultraviolet-light-sensitive dye that is sold by Security Equipment Corporation, but a number of such products are readily available. Immobilizing gas containers or canisters are typically available in several sizes. Most such canisters are 0.75 inches in diameter and of varying lengths, depending on the amount of gas contained therein. A common length for such a canister 16 is 3.5 inches to the end of valve 18. A canister of such length may contain about 22 grams of gas. The length and diameter of compartment 14 may be selected to be of any convenient dimensions.

The end of barrel 12 which includes compartment 14 may be enclosed by cap 20, which is shown in FIG. 1. Cap 20 may be made of any convenient material, and a variety of well-known plastics are suitable. Preferably, cap 20 is adapted to fit snugly over the end of barrel 12, but be easily removable when it is necessary or desirable to use the baton to disperse the personal defense gas from canister 16.

At the other end of barrel 12 is located another compartment 22, which may be adapted for storage of keys, currency, coins and other personal objects. Compartment 22 may also be used to contain a ballast material to provide weight to baton 10 for balance, or to facilitate use of the baton to block an attack or to strike out against an attacker. As an example, a roll of quarter-dollar coins may be stored in compartment 22 for ballast. Compartment 22 may be closed by cap 24, which may be similar to cap 20. Cap 24 may also be adapted to attach to the end of barrel 12 by threaded engagement (not shown), to provide additional security for the contents of compartment 22.

Mounted atop barrel 12 in the preferred embodiment of FIGS. 1–4 is detachable light 26. As shown in the drawings, light 26 is a battery-powered penlight that is activated by depressing the pen clip, although it could be of any convenient shape, size and means of activation. Light 26 is mounted atop barrel 12 by means of light mount 28, which is adapted to hold the light securely atop barrel 12 while allowing it to be detachable for separate use or for ease of battery replacement. It is desirable that light 26 be mounted so as to direct a beam of light along the direction of the axis of barrel 12. Of course, it will be appreciated that light 26 and light mount 28 could be replaced by a light that is integrally formed within barrel 12. Behind light 26 is located carrying strap 30, which is provided for convenience in carrying and using baton 10. Strap 30 may be formed of any convenient material such as an elasticized nylon or other fabric, or it may be a braided nylon cord. It may also be provided of any convenient width and length, although preferred results have been obtained when the strap is of such size so as to fit comfortably around a user's wrist while grasping baton 10 with the hand.

Valve 18 is typically of a type that may be actuated so as the disperse the contents of the container by being moved in an axial direction towards container 16 (along its long axis). The operation of such common valves is well known. In communication with valve 18 is discharge nozzle 32.

Nozzle 32 is similar to nozzles commonly in use with canisters such as container 16, except that it is adapted so as to direct the spray of gas in an axial direction, along the long axis of barrel 12. Nozzle 32 has a passage therethrough or throat 34 that is of convenient length and diameter, although smaller in diameter than valve 18. A throat of about 0.02 inches in diameter will allow the spray from container 16 to travel about 6–8 feet before fanning out significantly, allowing the user to defend himself or herself from a safe distance out of the reach of an attacker. Nozzle 32 is also provided with a throat entry 35, which is slightly larger than valve 18, which will allow for seating of valve 18 within the nozzle. Preferably, entry 35 is conical in shape, the walls of which are disposed at an angle of about 20 degrees from the axis of barrel 12, so as to allow for proper seating of valve 18 in the nozzle despite slight variations in the alignment of valve 18 from container 16. Nozzle 32 is also provided with a throat exit 36 that is preferably conical or hemispherical in shape, so as to prevent wind from adversely affecting the direction of spray from the nozzle.

Nozzle 32 and light 26 cooperate in the arrangement of the components of baton 10 so that the user may direct a beam of light along the axial direction in which the spray is dispersed from container 16.

As shown in FIGS. 1–4, baton 10 is provided with a safety mechanism that may be operated to place valve 18 in a condition of inoperability. Depending from nozzle 32 in a radial direction (from the axis of barrel 12) is nozzle flange 38. Surrounding the portion of nozzle 32 below flange 38 is safety collar 40, which is adapted so that nozzle 32 may be rotated through a limited arc therein from a position in alignment with recess 42 to a position in which flange 38 is restrained from further rotation by flange stop 44. Recess 42 is of a size and shape that when the nozzle is rotated to align with it, nozzle 32 may be moved in an axial direction towards valve 18 without mechanical interference between flange 38 and collar 40. Such axial movement of nozzle 32 will depress valve 18 and release the contents of container 16 through the nozzle. Nozzle 32 also may be rotated in a direction away from recess 42 so that flange 38 is restrained by contact with collar 40 from axial movement towards valve 18. Flange stop 44 is provided for convenience so as to restrain the motion of nozzle 32 in a radial direction. The size, shape and orientation of nozzle and collar components 38, 40, 42 and 44 may vary somewhat from that shown in the drawings.

Figures 3, 4, 5:
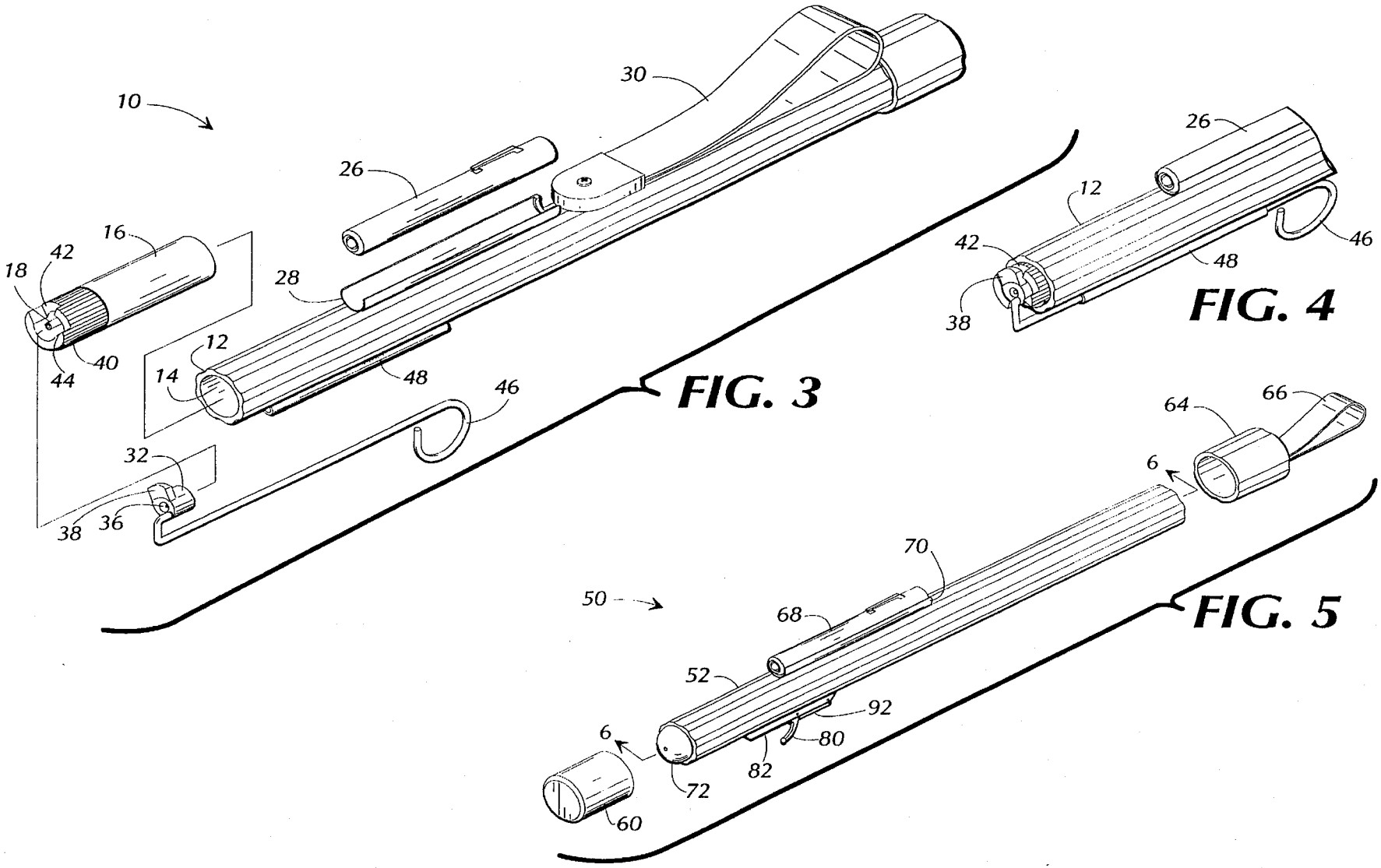
FIG. 3 is an exploded perspective view of the preferred embodiment of FIG. 1.
FIG. 4 is a partial perspective view of a portion of the preferred embodiment of FIG. 1, showing the safety mechanism disengaged so that the defense spray may be discharged.
FIG. 5 is a perspective view of an alternative embodiment of the invention.

Baton 10 is also equipped with a means for manually actuating valve 18 without bringing the actuating hand near discharge nozzle 32. As shown in the embodiment of FIGS. 1–4, such means comprises trigger 46, which may be formed in the shape of a ring at one end, and which communicates through guide or sleeve 48 with nozzle 32. The end of trigger 46 which communicates with the nozzle is rotatably attached to the nozzle at a location away from flange 38, and the portion of trigger 46 that passes through sleeve 48 may be rotated therein. In such configuration, trigger 46 may be rotated in a radial direction (relative to the axis of barrel 12) so as to rotate nozzle 32 in an opposing radial direction between a position in which flange 38 is restrained by collar 40 from axial movement towards valve 18 (as shown in FIG. 1) to a position of alignment of flange 38 with recess 42 (as shown in FIG. 4). When flange 38 is aligned with recess 42, trigger 46 is in an "unlocked" position, so that pulling of the trigger in an axial direction from an "off" position to an "on" position will move nozzle 32 towards valve 18 so as to depress the valve and release the contents of container 16 through the nozzle. On the other hand, when flange 38 is restrained by collar 40, the trigger is "locked" in the "off" position and cannot be pulled to the "on" position so as to release the contents of container 16.

Baton 10 may be of any convenient size. Smaller sized batons, such as of 7–9 inches in length, may be carried conveniently in a purse or coat pocket. Larger batons, such as of 12–18 inches in length, may be more comfortable for joggers or recreational walkers to carry.

Referring now to FIGS. 5–8, an alternative embodiment of the apparatus of this invention is illustrated. This embodiment, generally designated by the reference numeral 50, includes an elongate tube member or barrel 52, which is similar in size, shape and construction to barrel 12 of baton 10. At one end of barrel 52 is located compartment 54, which is suitable for receiving a replaceable personal defense gas container or canister 56. Container 56, which is comparable to container 16 of baton 10, includes valve 58, through which the contents may be discharged. The end of barrel 52 which includes compartment 54 may be enclosed by cap 60 (shown in FIG. 5), which is similar to cap 20 of baton 10.

At the other end of barrel 52 is located another compartment 62, which is similar to compartment 22 of baton 10. Compartment 62 may be closed by cap 64, which may be of similar size, shape and construction to cap 60. Cap 64 may also be adapted to attach to the end of barrel 52 by threaded engagement (not shown), to provide additional security for the contents of compartment 62.

In the embodiment of baton 50, carrying strap 66 is attached to the end of cap 64. In the alternative, a carrying strap similar to strap 66 could be attached to barrel 52 behind light 56, such as in the arrangement of strap 30 on barrel 12 of baton 10. Strap 66 is provided for convenience in carrying and using baton 50, and it may be formed of any convenient material such as an elasticized nylon or other fabric, or it may be a braided nylon cord. It may also be provided of any convenient width and length, although preferred results have been obtained when the strap is of such size so as to fit comfortably around a user's wrist while grasping baton 50 with the hand.

Mounted atop barrel 52 in the embodiment of FIGS. 5–8 is detachable light 68, which is similar to light 26 of baton 10. Light 68 is mounted atop barrel 52 by means of light mount 70, which is similar to light mount 28 of the embodiment of the invention illustrated in FIGS. 1–4. It is desirable that light 68 be mounted so as to direct a beam of light along the direction of the axis of barrel 52. Of course, it will be appreciated that light 68 and light mount 70 could be replaced by a light that is integrally formed within barrel 52.

Valve 58, which is similar to valve 18 of baton 10, is typically of a type that may be actuated so as the disperse the contents of the container by being moved in an axial direction towards container 56 (along its long axis). The operation of such common valves is well known. In communication with valve 58 is discharge nozzle 72, which is adapted to be attached by threaded engagement to barrel 52.

Nozzle 72 is adapted so as to direct the spray of gas in an axial direction, along the long axis of barrel 52. Nozzle 72 has a passage therethrough or throat 74 that is of convenient length and diameter, although smaller in diameter than valve 58. A throat of about 0.02 inches in diameter will allow the spray from container 56 to travel about 6–8 feet before fanning out significantly, allowing the user to defend himself or herself from a safe distance out of the reach of an attacker. Nozzle 72 is also provided with a throat entry 76, which is slightly larger than valve 58, which will allow for seating of valve 58 within the nozzle. Preferably, entry 76 is conical in shape, the walls of which are disposed at an angle of about 20 degrees from the axis of barrel 52, so as to allow for proper seating of valve 58 in the nozzle despite slight variations in the alignment of valve 58 from container 56. Nozzle 72 is also provided with a throat exit 78 that is preferably conical or hemispherical in shape, so as to prevent wind from adversely affecting the direction of spray from the nozzle. Nozzle 72 and light 68 cooperate in the arrangement of the components of baton 50 so that the user may direct a beam of light along the axial direction in which the spray is dispersed from container 56.

Baton 50 is equipped with a means for manually actuating valve 58 without bringing the actuating hand near discharge nozzle 72. Furthermore, as shown in FIGS. 5–8, baton 50 is provided with a safety mechanism that may be operated to place valve 58 in a condition of inoperability. Trigger 80, mounted to barrel 52 by means of trigger mount 82, is adapted to rotate about axis 84 therein. Trigger 80 may be of any convenient shape and size, but if it is slightly curved towards the end of barrel 52 to which nozzle 72 is attached, it will be somewhat less likely to catch on the side or edge of a purse or pocket when it is removed therefrom.

Figure 6:
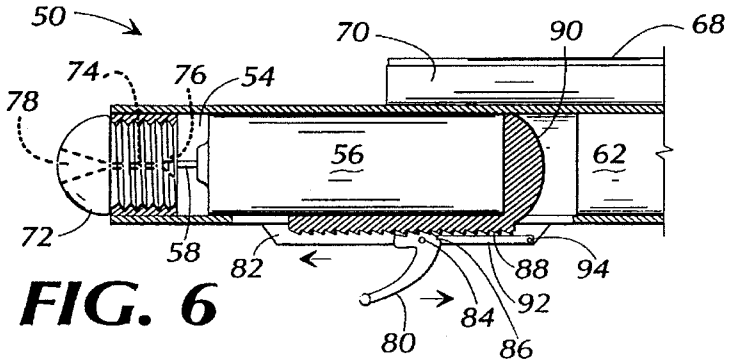
FIG. 6 is a sectional view taken along lines 6—6 of FIG. 5.
Figure 7:
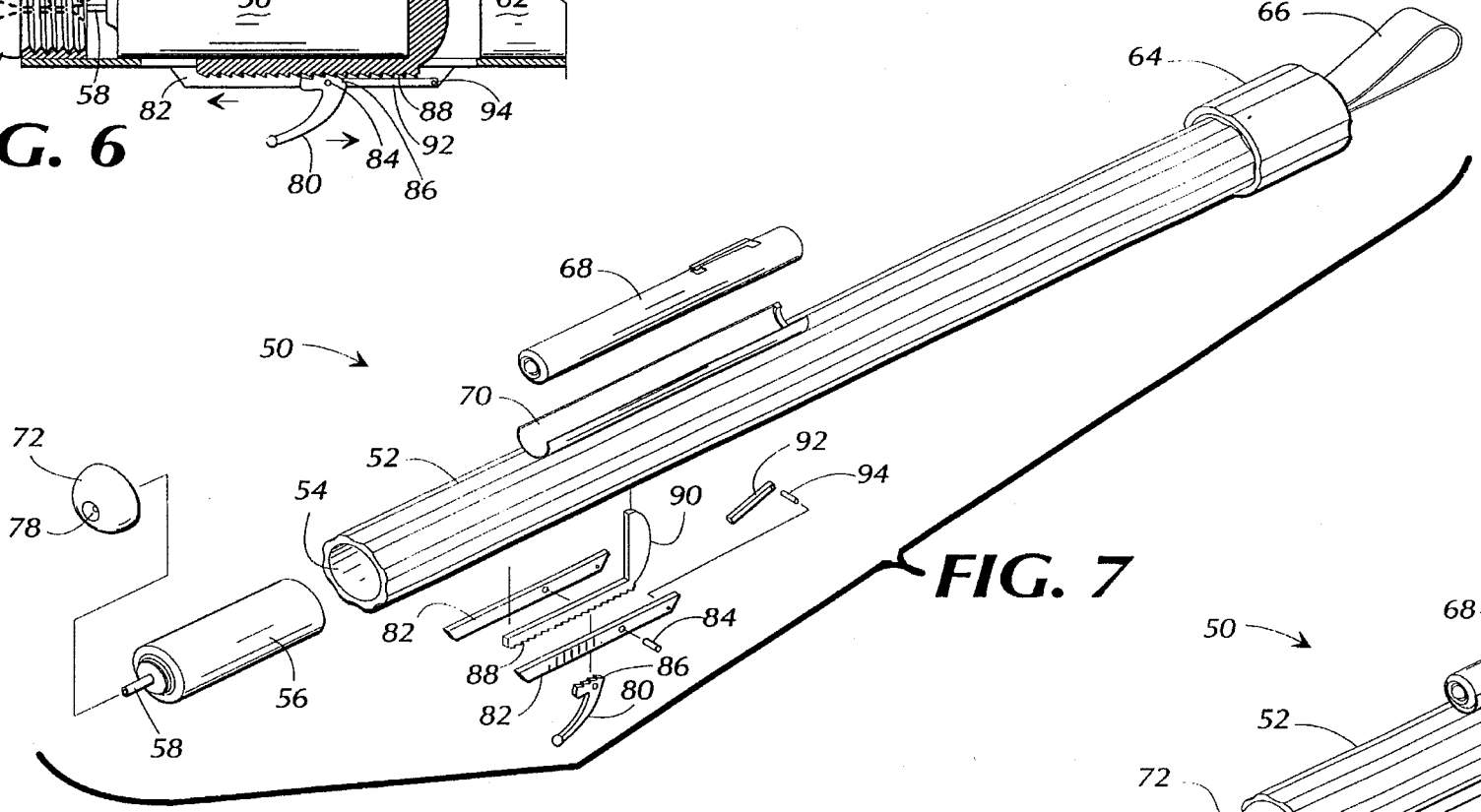
FIG. 7 is an exploded perspective view of the preferred embodiment of FIG. 5.
Figure 8:
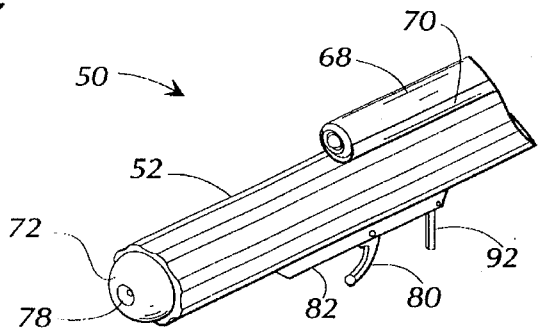
FIG. 8 is a partial perspective view of a portion of the alternative embodiment of FIG. 5, showing the safety mechanism disengaged so that the defense spray may be discharged.

As illustrated in FIG. 6, trigger 80 is provided with pinion 86, which is adapted to mate with rack 88 of defense spray container carrier 90. Trigger block 92, which is adapted to rotate about axis 94, is utilized to place trigger 80 in a "locked" position by mechanical interference therewith, so that trigger 80 cannot be pulled back in a direction away from nozzle 72, as illustrated in FIGS. 5 and 6. Trigger block 92 may be manually rotated away from such position of mechanical interference with trigger 80, as shown in FIG. 8, to place trigger 80 in an "unlocked" position.

When trigger 80 is in the "unlocked" position, it may be manually pulled in an axial direction away from the nozzle end of baton 50 from an "off" position to an "on" position. Such movement of trigger 80 will, through the action of pinion 86 and rack 88, cause carrier 90 to move container 56 with its valve 58 towards the entry 76 of nozzle 72. Valve 58, which is larger in diameter than nozzle throat 74, will be directed by entry 76 towards throat 74, where by mechanical interference with the smaller throat, it will be impeded from further motion and will be depressed so as to release the contents of container 56 through the nozzle.

Although this description contains many specifics, these should not be construed as limiting the scope of the invention but as merely providing illustrations of some of the presently preferred embodiments of this invention. Thus, the invention, as described herein, is susceptible to various modifications and adaptations, and the same are intended to be comprehended within the meaning and range of equivalents of the appended claims.

What is claimed is:

1. A personal defense baton, comprising:

a) an elongate tube member which includes at one end a compartment for receiving a defense spray container having a valve for dispersal therethrough of a personal defense gas;

b) a discharge nozzle which communicates with the valve so as to direct a spray of the personal defense gas from the container in a generally axial direction from the end of the tube member in which the container is located when the valve is actuated;

c) a trigger located away from the discharge nozzle which may be manually operated to actuate the valve without bringing the operating hand near the discharge nozzle, said trigger having an "on" and an "off" position, which positions are axially disposed with respect to each other;

d) a safety mechanism that can be operated to place the valve in a condition of inoperability; and e) a light device that is arranged so as to permit a beam of light to be directed along the axial direction in which the spray is dispersed, wherein the trigger communicates with the discharge nozzle so that when the trigger is moved from the "off" to the "on" position, the discharge nozzle will move in an axial direction toward the valve to actuate the valve.

2. The personal defense baton of claim 1, wherein the safety mechanism can be operated manually without bringing the operating hand near the discharge nozzle.

3. The personal defense baton of claim 1, wherein the trigger has a "locked" position and an "unlocked" position, which positions are radially disposed with respect to each other.

4. The personal defense baton of claim 3, wherein the safety mechanism comprises:

a) a safety collar having a recess therein, which collar is adapted to receive the discharge nozzle so as to permit rotation of the nozzle therein while the discharge nozzle is in communication with the valve;

b) a radially-projecting flange on the discharge nozzle, which flange is sized to be received within the recess in the safety collar;

c) means for rotatably connecting the discharge nozzle to the trigger, so that rotation of the trigger about the axis of the elongate body from the "locked" position to the "unlocked" position will rotate the discharge nozzle from a first position in which the flange communicates with the collar so as to prevent the nozzle from being moved in an axial direction toward the valve, to a second position in which the flange may be received within the recess of the collar as the nozzle is moved in an axial direction toward the valve, to permit such movement.

5. A personal defense baton, comprising:

a) an elongate tube member which includes at one end a compartment for receiving a defense spray container having a valve for dispersal therethrough of a personal defense gas;

b) a discharge nozzle which communicates with the valve so as to direct a spray of the personal defense gas from the container in a generally axial direction from the end of the tube member in which the container is located when the valve is actuated;

c) a trigger located away from the discharge nozzle which may be manually operated to actuate the valve without bringing the operating hand near the discharge nozzle, said trigger having an "on" and an "off" position, which positions are axially disposed with respect to each other;

d) a safety mechanism that can be operated to place the valve in a condition of inoperability; and e) a light device that is arranged so as to permit a beam of light to be directed along the axial direction in which the spray is dispersed, wherein the trigger communicates with the defense spray container so that when the trigger is moved from the "off" to the "on" position, the valve of the defense spray container will move in an axial direction toward the discharge nozzle to actuate the valve.

6. The personal defense baton of claim 5, wherein the trigger communicates with the defense spray container by means of a rack and pinion, whereby the trigger is mounted so as to rotate about the axis of a pinion which is in engagement with a rack that communicates with the defense spray container, so that movement of the trigger from the "off" to the "on" position will move the defense spray container in an axial direction toward the discharge nozzle to actuate the valve.

7. The personal defense baton of claim 5, wherein the safety mechanism comprises a trigger block which is located adjacent to the trigger, which trigger block may be manually moved from an "unlocked" position, which permits free movement of the trigger from the "off" to the "on" position, to a "locked" position, in which the trigger block physically impedes the trigger and prevents it from moving from the "off" to the "on" position.

8. A personal defense baton comprising:

a) an elongate tube member which includes at one end a compartment for receiving a defense spray container having a valve for dispersal therethrough of a personal defense gas;

b) a discharge nozzle which communicates with the valve so as to direct a spray of the personal defense gas from the container in a generally axial direction from the end of the tube member in which the container is located when the valve is actuated, said discharge nozzle being disposed to actuate the valve by moving in an axial direction toward the valve;

c) means for manually actuating the valve without bringing the actuating hand near the discharge nozzle; and d) a safety mechanism that can be operated to place the valve in a condition of inoperability, which safety mechanism includes:

i) a safety collar having a recess therein, which collar is adapted to receive the discharge nozzle so as to permit rotation of the nozzle therein while the discharge nozzle is in communication with the valve;

ii) a radially-projecting flange on the discharge nozzle, which flange is sized to be received within the recess of the safety collar; and iii) means for rotating the discharge nozzle from a first position in which the flange communicates with the collar so as to prevent the nozzle from being moved in an axial direction toward the valve, to a second position in which the flange may be received within the recess of the collar as the nozzle is moved in an axial direction toward the valve, to permit such movement.

* * * * *